US006716009B2

(12) United States Patent
Sowa et al.

(10) Patent No.: US 6,716,009 B2
(45) Date of Patent: Apr. 6, 2004

(54) SCROLL TYPE COMPRESSOR

(75) Inventors: Masato Sowa, Kariya (JP); Kazuhiro Nomura, Kariya (JP); Takayuki Hirano, Kariya (JP); Hisao Hamasaki, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/438,515

(22) Filed: May 15, 2003

(65) Prior Publication Data

US 2003/0228235 A1 Dec. 11, 2003

(30) Foreign Application Priority Data

Jun. 11, 2002 (JP) ..... P2002-170008

(51) Int. Cl.[7] ..... F01C 1/02

(52) U.S. Cl. ..... 418/55.1; 418/15; 418/83; 418/55.5; 418/57

(58) Field of Search ..... 418/55.1, 15, 83, 418/55.5, 57

(56) References Cited

U.S. PATENT DOCUMENTS 4,496,296 A * 1/1985 Arai et al. ..... 418/55.5
4,545,747 A * 10/1985 Tamura et al. ..... 418/55.1
4,714,415 A 12/1987 Mizuno et al.
4,818,195 A * 4/1989 Murayama et al. ..... 418/55.1
5,478,219 A * 12/1995 Nardone et al. ..... 418/55.2
6,056,523 A * 5/2000 Won et al. ..... 418/15
6,149,401 A 11/2000 Iwanami et al.

FOREIGN PATENT DOCUMENTS

EP 1 156 222 A1 11/2001
JP 62070681 A * 4/1987 ..... F04C/18/02
JP 02264176 A * 10/1990 ..... F04C/18/02
JP 5-38378 5/1993
JP 7-158570 6/1995
JP 7-233788 9/1995

* cited by examiner

*Primary Examiner*—Thomas Denion
*Assistant Examiner*—Theresa Trieu
(74) *Attorney, Agent, or Firm*—Morgan & Finnegan, LLP

(57) ABSTRACT

A scroll type compressor includes a housing, a movable scroll member, a plurality of compression chambers, a discharge port, a communication passage and a relief valve. The communication passage interconnects each intermediate compression chamber with the discharge port. The communication passage has a first portion and a second portion. The first portion extends from the first intermediate compression chamber and the second portion extends from the second intermediate compression chamber. The first portion and the second portion meet at a meeting point on the way in the communication passage before reaching the discharge port. The relief valve is placed between the meeting point and the discharge port inclusive of the meeting point in the communication passage. The relief valve opens the communication passage when the pressure in the first and the second intermediate pressure chambers is higher than the pressure in the discharge port.

17 Claims, 2 Drawing Sheets

SCROLL TYPE COMPRESSOR

BACKGROUND OF THE INVENTION

The present invention relates to a scroll type compressor.

In the scroll type compressor, Japanese Unexamined Patent Publication No. 7-158570 discloses to prevent power loss, vibration and noise that are caused by an excessive compression of the scroll type compressor. In the Publication, a plurality of intermediate compression chambers, in which gas compression is in progress, is connected to a discharge port respectively through communication passages. In each communication passage, a relief valve is placed and is opened when the pressure in the intermediate compression chambers is higher than the pressure in the discharge port. Therefore, when the pressure in the discharge port is relatively low, the relief valve opens the communication passage and thus the intermediate compression chambers are directly connected to the discharge port. Thereby, the excessive compression of the scroll type compressor, in which gas compression continues until the compression chambers substantially reach the center of a scroll of a fixed spiral wall, is prevented.

In the above-mentioned Publication, however, a plurality of relief valves is placed so as to correspond to the intermediate compression chambers, respectively. This structure increases the number of parts of the scroll type compressor. Furthermore, a plurality of the relief valves generates pressure pulsation due to a time lag where each relief valve is opened. Thereby, abnormal sound and vibration generate.

SUMMARY OF THE INVENTION

The present invention is directed to a scroll type compressor which prevents an excessive compression by using a relatively small number of parts.

The present invention has a following feature. A scroll type compressor includes a housing, a movable scroll member, a plurality of compression chambers, a discharge port, a communication passage and a relief valve. The housing has a fixed scroll member which has a fixed base plate and a fixed spiral wall that extends from the fixed base plate. The movable scroll member is placed in the housing. The movable scroll member has a movable base plate and a movable spiral wall that extends from the movable base plate. The movable spiral wall is engaged with the fixed spiral wall. The compression chambers are defined between the movable scroll member and the fixed scroll member, and are moved radially and inwardly to compress gas by orbiting the movable scroll member relative to the fixed scroll member while reducing their volume. The compression chambers have at least a first intermediate compression chamber and a second intermediate compression chamber, in which gas compression is in progress, respectively. The discharge port is formed substantially at the center of the fixed base plate or the movable base plate for sending the compressed gas to an outside of the housing. The communication passage interconnects each intermediate compression chamber with the discharge port. The communication passage has at least a first portion and a second portion. The first portion extends from the first intermediate compression chamber and the second portion extends from the second intermediate compression chamber. The first portion and the second portion meet at a meeting point on the way in the communication passage before reaching the discharge port. The relief valve is placed between the meeting point and the discharge port inclusive of the meeting point in the communication passage. The relief valve opens the communication passage when the pressure in the first and the second intermediate pressure chambers is higher than the pressure in the discharge port.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A scroll type compressor according to a preferred embodiment of the present invention will now be described with reference to FIG. 1. In the present embodiment, the claimed invention is applied to an electric scroll type compressor for a fuel cell of an electric vehicle (hereinafter referred to as a compressor). A left side of FIG. 1 is a front side of the compressor and a right side of FIG. 1 is a rear side thereof.

Figure 1:
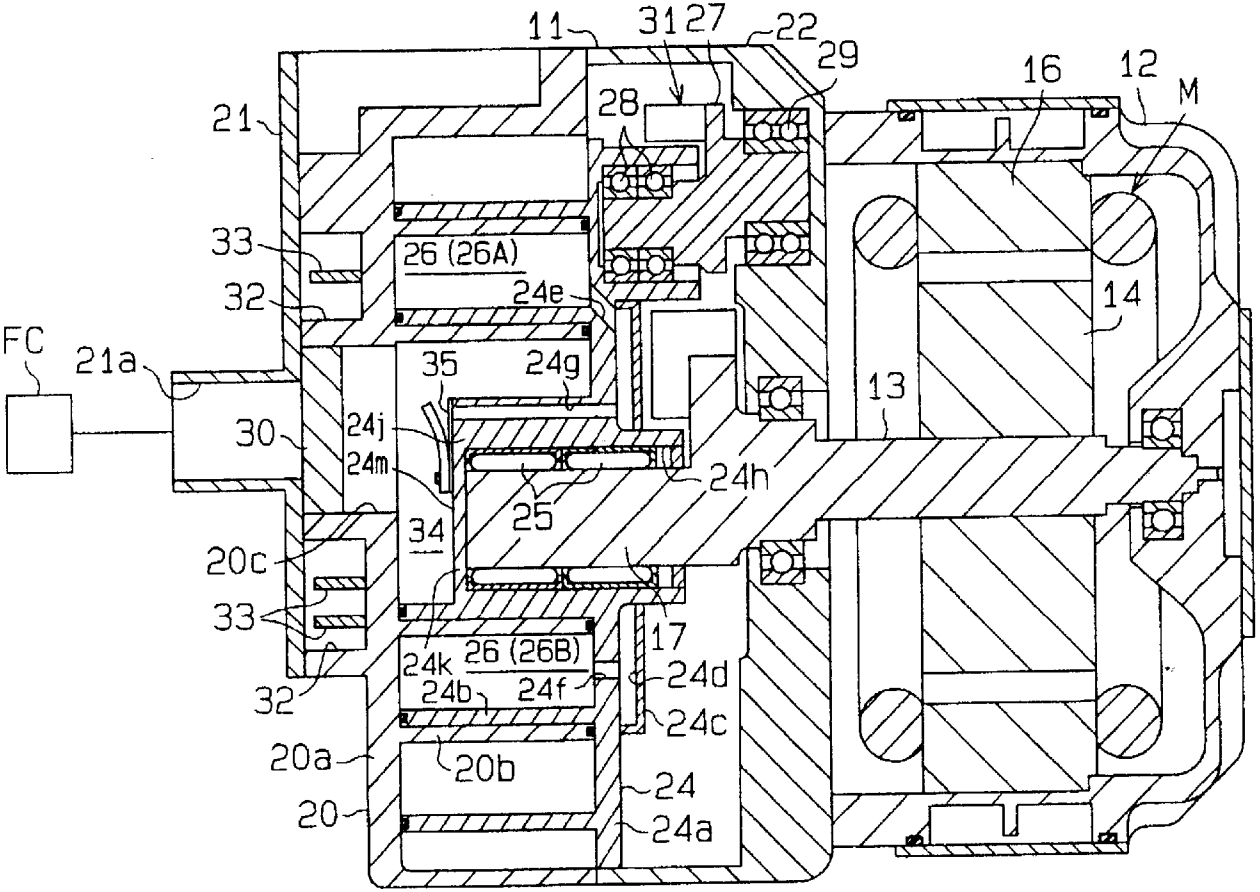
FIG. 1 is a longitudinal-sectional view illustrating a scroll type compressor according to a preferred embodiment of the present invention.

Referring to FIG. 1, the compressor compresses a gas that is supplied to a fuel cell FC of an electric vehicle. In the present embodiment, more specifically, the compressor is used for compressing air that is supplied to the fuel cell FC. A rotational speed of the compressor is controlled in a such manner that the amount of air which is supplied to the fuel cell FC unit time increases as a running speed of the electric vehicle becomes high, and that, in contrast, the amount of air which is supplied to the fuel cell FC unit time decreases as the running speed of the electric vehicle becomes low. Furthermore, even in a state when the electric vehicle is stopped due to a red light, the compressor is driven at a relatively low speed in order to operate other electrical equipments such as an electric type refrigerant compressor for an air conditioning apparatus. That is, the compressor is in an idling state.

Now, the structure of the compressor will be described. Still referring to FIG. 1, the compressor includes a compression mechanism and an electric motor. A housing of the compressor or a compressor housing includes a first housing unit 11 at the compression mechanism side and a second housing unit 12 at the electric motor side. The rear end of the first housing unit 11 is joined to the front end of the second housing unit 12. The first housing unit 11 and the second housing unit 12 are made of aluminum or aluminum alloy. A rotary shaft 13 is supported for rotation in the compressor housing. In the second housing unit 12, a rotor. 14, which constitutes an electric motor M, is fixed on the rotary shaft 13 so as to integrally rotate with the rotary shaft 13. Also, in the second housing unit 12, a stator 16, which also constitutes the electric motor M, is fixed on the inner circumferential surface of the second housing unit 12 so as to surround the rotor 14.

The first housing unit 11 includes a fixed scroll member 20, a front housing member 21 and a rear housing member 22. The rear end of the front housing member 21 is fixedly joined to the front end of the fixed scroll member 20. The front end of the rear housing member 22 is fixedly joined to the rear end of the fixed scroll member 20. The fixed scroll member 20 has a fixed base plate 20*a* and a fixed spiral wall 20*b* that extends from the rear surface of the fixed base plate 20*a*.

A main crankshaft 17 extends from the front end of the rotary shaft 13 so as to be eccentric with respect to a rotary axis of the rotary shaft 13. A movable scroll member 24 is supported by the crankshaft 17 through a bearing 25 so as to face to the fixed scroll member 20. The movable scroll member 24 has a disc-shaped movable base plate 24*a* and a movable spiral wall 24*b* that extends from the front surface of the movable base plate 24*a* toward the fixed scroll member 20.

The movable spiral wall 24*b* is engaged with the fixed spiral wall 20*b* while the distal end surfaces of the spiral walls 24*b* and 20*b* are respectively in contact with the facing scroll base plates 24*a* and 20*a*. Therefore, the fixed base plate 20*a*, the fixed spiral wall 20*b*, the movable base plate 24*a* and the movable spiral wall 24*b* cooperate to form a plurality of compression chambers 26 between the fixed scroll member 20 and the movable scroll member 24.

A boss 24*j* protrudes substantially from the center of a surface of the movable base plate 24*a* at the movable spiral wall side of the movable scroll member 24 and receives the crankshaft 17. A recess 24*h* in which the crankshaft 17 is inserted is formed in the boss 24*j* and the recess 24*h* serves as an inserted portion. The boss 24*j* has a bottom wall 24*k* at the bottom of the recess 24. Thereby, the opposite side (or the left side) of the recess 24*h* to the side (or the right side) where the crankshaft 17 is inserted is closed. Thus, the crankshaft 17 is arranged so as to protrude from the movable base plate 24*a* toward the fixed base plate 20*a*, thereby enabling the size of the compressor to become compact by the protruding length of the crankshaft 17 in the direction of the rotary axis of the rotary shaft 13.

In the fixed scroll member 20, a discharge port 20*c* is formed substantially at the center of the fixed base plate 20*a*. Also, in the front housing member 21, an outlet 21*a* is formed. Furthermore, a central chamber 34 is a space surrounded by the fixed scroll member 20 and the movable scroll member 24 substantially at a central part of the scroll of the fixed spiral wall 20*b*. The discharge port 20*c* interconnects the outlet 21*a* with the central chamber 34. An air filter 30 is placed in the discharge port 20*c*.

A mechanism 31 for preventing a self rotation or a self rotation preventing mechanism 31 is arranged between the movable base plate 24*a* of the movable scroll member 24 and the inner wall surface of the rear housing member 22, which opposes the movable base plate 24*a*. The self rotation preventing mechanism 31 includes an auxiliary crankshaft 27, bearings 28 and 29.

When the rotary shaft 13 is driven by the electric motor M, the movable scroll member 24 is revolved relative to the fixed scroll member 20 through the crankshaft 17. At this time, a self rotation of the movable scroll member 24 is prevented by the self rotation preventing mechanism 31 and only the orbital movement of the movable scroll member 24 is permitted. As the compression chambers 26 are moved from the outer circumferential side of the spiral walls 20*b* and 24*b* of the scroll members 20 and 24 substantially toward the center of the scroll of the fixed spiral wall 20*b* by the orbital movement of the movable scroll member 24, the volumes of the compression chambers 26 are each reduced. Thereby, the air that has been introduced into the compression chambers 26 is compressed. After the air compression, the compressed air is sent from the innermost compression chamber to the fuel cell FC that is located outside of the compressor through the discharge port 20*c* and the outlet 21*a*.

The front housing member 21 and the fixed scroll member 20 cooperate to form a cooling chamber 32 therebetween. Therefore, the cooling chamber 32 adjoins the compression chambers 26 through the fixed base plate 20*a* of the fixed scroll member 20. In the cooling chamber 32, a cooling fin 33 is installed on the fixed base plate 20*a* of the fixed scroll member 20. Cooling water of low temperature (or a coolant) is supplied from a heat exchanger, which is located outside of the compressor and is not shown in the drawings, to the cooling chamber 32. A heat exchange is performed between the cooling water of low temperature in the cooling chamber 32 and the air in the compression chambers 26 where the air compression is in progress. Thereby, a rise of temperature of the air is restrained and thus the work load of the compressor is reduced.

Now, the structure that prevents an excessive compression of the compressor will be described. As a running speed of the electric vehicle increases, the rotational speed of the electric motor M is increased. Thereby, displacement of the air in the compressor unit time is increased. As the displacement of the air in the compressor increases, the pressure in the discharge port 20*c* is increased. When the electric vehicle is run in a range of a normal speed, for example, if the electric motor M is rotated at a normal rotational speed of 5000 revolutions per minute or rpm, the pressure in the discharge port 20*c* substantially becomes 130 kilopascal or kPa.

On the contrary, as the running speed of the electric vehicle decreases, the rotational speed of the electric motor M is decreased. Thereby, the displacement of the air in the compressor unit time is decreased. As the displacement of the air in the compressor decreases, the pressure in the discharge port 20*c* is decreased. While the electric vehicle is stopped, for example, if the electric motor M is rotated at a rotational speed of 1000 rpm in an idling state, the pressure in the discharge port 20*c* substantially becomes 50 to 60 kPa.

In the compressor, a winding number and a shape of each of the spiral walls 20*b* and 24*b* are set in a such manner that a compressive efficiency of the compressor is enhanced during the rotation of the electric motor M at a normal rotational speed. Therefore, if the running speed of the electric vehicle decreases and the rotational speed of the electric motor M becomes less than the normal rotational speed thereof, the compressor, which does not have a structure for preventing excessive compression of the air in the compression chambers 26 as described later, tends to excessively compress the air in the compression chambers 26. The tendency of the excessive compression becomes remarkable, for example, in the idling state. More specifically, in a state when the electric vehicle is stopped, rotation of a drive motor, which makes a relatively loud noise and is not shown in the drawings, is also stopped. Consequently, the noise that is caused by the excessive compression of the air in the compressor becomes remarkable.

In order to prevent the excessive compression of the air in the compressor in the idling state of the electric motor M, the compressor according to the present embodiment is structured as follows. In the movable base plate 24*a* of the movable scroll member 24, an annular cover 24*c* is fixedly joined to the back surface or the rear surface of the movable base plate 24*a*, from which the movable spiral wall 24*b* does not extend, so as to surround the crankshaft 17. The cover 24*c* and the movable base plate 24*a* cooperate to form a communication chamber 24*d* therebetween.

In the movable scroll member 24, a first communication hole 24*e* and a second communication hole 24*f* extend through the movable base plate 24*a*. The first communication hole 24*e* interconnects the communication chamber 24*d* with one of the compression chambers 26, in which air compression is in progress (hereinafter referred to as a first intermediate compression chamber 26A). In a similar manner, the second communication hole 24*f* interconnects the communication chamber 24*d* with one of the compression chambers 26, in which air compression is in progress (hereinafter referred to as a second intermediate compression chamber 26B). Also, in the movable scroll member 24, a third communication hole 24*g* is formed through the boss 24*j* so as to interconnect the communication chamber 24*d* with the central chamber 34. In the boss 24*j*, the third communication hole 24*g* is opened to the central chamber 34 on an outer surface 24*m* of the bottom wall 24*k*, which faces to the fixed base plate 20*a* of the fixed scroll member 20.

In the central chamber 34, a relief valve 35, which is a reed valve, is placed on the bottom wall 24*k* of the boss 24*j* so as to correspond to the opening of the third communication hole 24*g* on the outer surface 24*m*. That is, the relief valve 35 is placed between the bottom wall 24*k* of the boss 24*j* and the fixed base plate 20*a* of the fixed scroll member 20 in the central chamber 34 so as not to interfere with the fixed scroll wall 20*b* of the fixed scroll member 20 by the orbital movement of the movable scroll member 24. The relief valve 35 is opened when the pressure in the communication chamber 24*d* or the pressure in the intermediate compression chambers 26A and 26B is higher than the pressure in the central chamber 34 or the pressure in the discharge port 20*c*.

In the present embodiment, a communication passage includes the first communication hole 24*e*, the second communication hole 24*f*, the communication chamber 24*d*, the third communication hole 24*g* and the central chamber 34. The communication passage interconnects each of the first intermediate compression chamber 26A and the second intermediate compression chamber 26B with the discharge port 20*c*. In other words, the first communication hole 24*e* extends from the first intermediate compression chamber 26A to the communication chamber 24*d*, and the second communication hole 24*f* extends from the second intermediate compression chamber 26B to the communication chamber 24*d*. Thus, each of the first and second communication holes 24*e* and 24*f* communicates with the communication chamber 24*d*. In the present claim, a first portion includes the first communication hole 24*e* and the communication chamber 24*d*. Also, a second portion includes the second communication hole 24*f* and the communication chamber 24*d*. That is, the first portion and the second portion of the communication passage meet on the way to form one communication passage, and the met communication passage reaches the discharge port 20*c* through the third communication hole 24*g* and the central chamber 34.

Meanwhile, the intermediate compression chambers 26A and 26B are set, for example, in a such manner that the pressure of the air therein is raised substantially to 70 kPa. Therefore, for example, if rotation of the electric motor M is varied from the normal rotational speed state to the idling state and thus the pressure in the discharge port 20*c* is lowered to 50 to 60 kPa, the relief valve 35 is opened and thereby the intermediate compression chambers 26A and 26B directly communicates with the discharge port 20*c*. Accordingly, the air compression does not continue until the compression chambers 26 reach the middle of the scroll of the fixed spiral wall 20*b*, in other words, until the pressure in the compression chambers 26 rises to a predetermined pressure value, such as 130 kPa, that is far more than the pressure value in the discharge port 20*c*, such as 50 to 60 kPa. That is, the excessive compression of the compressor is prevented.

In the present embodiment, following effects are obtained.

(1) The first portion and the second portion of the communication passage, which extend respectively from the intermediate compression chambers 26A and 26B, meet at a meeting point on the way in the communication passage, and the met communication passage reaches the discharge port 20*c*. The relief valve 35 is placed between the meeting point of the first portion and the second portion, and the discharge port 20*c* in the communication passage. The meeting point is located in the communication chamber 24*d*. That is, in the structure that prevents the excessive compression in the present embodiment, a plurality of the intermediate compression chambers 26A and 26B are opened and closed to the discharge port 20*c* by a single relief valve 35. Therefore, prevention of the excessive compression is achieved by using a relatively small number of parts. Furthermore, since the number of relief valves is one, abnormal sound and vibration generated due to a time lag where a plurality of relief valves is opened are prevented.

(2) The relief valve 35 is placed in a space that is surrounded by the fixed scroll member 20 and the movable scroll member 24. Therefore, for example, in comparison with a structure that a relief valve is placed outside of the space, such as placing on a back surface of the scroll members, the scroll members are easily miniaturized. That is, the compressor is easily miniaturized.

(3) The relief valve 35 is placed on the movable scroll member 24. If a relief valve is placed on a fixed scroll member, the thickness of a fixed base plate tends to be increased in view of a space for placing the relief valve. More specifically, in the structure where a cooling chamber adjoins the fixed base plate, as the thickness of the fixed base plate increases, an efficiency for exchanging heat between the cooling chamber and the compression chamber deteriorates. In the present embodiment where the relief valve 35 is placed on the movable scroll member 24, however, the thickness of the fixed base plate 20*a* is relatively reduced. Thereby, the heat exchanging efficiency is improved.

(4) The crankshaft 17, which supports the movable scroll member 24, is placed so as to protrude from the movable base plate 24*a* toward the fixed base plate 20*a*. Therefore, the compressor is miniaturized in an axial direction thereof by the protruding length of the crankshaft 17. In a structure where a crankshaft protrudes from a movable base plate toward a fixed base plate, in general, a region between a bottom wall of a boss of the crankshaft and the fixed base plate tends to become a dead space, in view of the relation between the height of a movable spiral wall and the necessary protruding length of the crankshaft 17 for supporting a movable scroll member. In the present embodiment, however, a predetermined volume of space is ensured in the region and the relief valve 35 is place on the outer surface 24*m* of the bottom wall 24*k*, which faces to the fixed base plate 20*a*. Thereby, the dead space is effectively utilized. Therefore, increase of the size of the compressor caused by placing the relief valve is prevented.

(5) The first portion and the second portion of the communication passage meet on the way in the communication chamber 24*d*, which is formed in the compressor housing, in other words, in a relatively large space. Therefore, the first communication hole 24*e* and the second communication hole 24*f*, which extend relatively from the first intermediate compression chamber 26A and the second intermediate compression chamber 26B, have a relatively large degree of freedom when approach the communication chamber 24*d*. Also, the central chamber 34, which extends from the discharge port 20*c*, and the third communication hole 24*g* have a relatively large degree of freedom when approach the communication chamber 24*d*. Thus, for example, in comparison with a structure that the first portion and the second portion are met to each other without forming the communication chamber or the relatively large space, arrangement of the communication passage is easily designed.

(6) The communication chamber 24*d* is easily formed by fixedly joining the cover 24*c* to the back surface of the movable base plate 24*a*. Also, each of the intermediate compression chambers 26A and 26B communicates with the communication chamber 24*d* by simply machining the movable base plate 24*a* in a such manner that the communication holes 24*e* and 24*f* extend through the movable base plate 24*a*. Such a structure enables the communication passage of the compressor to be easily formed.

(7) The communication chamber 24*d* is placed on the back surface of the movable base plate 24*a* while avoiding the self rotation preventing mechanism 31 and the boss 24*j*. Thereby, for example, in comparison with a structure that a communication passage, which interconnects intermediate compression chambers with a central chamber, is formed inside of a movable base plate, the thickness of the movable base plate is reduced. Also, the communication chamber 24*d* is formed to utilize a space defined between the movable base plate 24*a*, where the self rotation preventing mechanism 31 is installed, and the inner wall surface of the rear housing member 22, which faces to the movable base plate 24*a*. Therefore, the increase of the size in the axial direction of the compressor caused by forming the communication chamber 24*d* is restrained.

(8) The communication chamber 24*d*, the communication holes 24*e*, 24*f* and 24*g* are not formed on the fixed scroll member 20, but are formed on the movable scroll member 20. This structure enables the cooling chamber to adjoin the compression chamber 26 through the fixed base plate 20*a*. Thereby, the heat exchanging efficiency is suitably improved.

Figure 2:
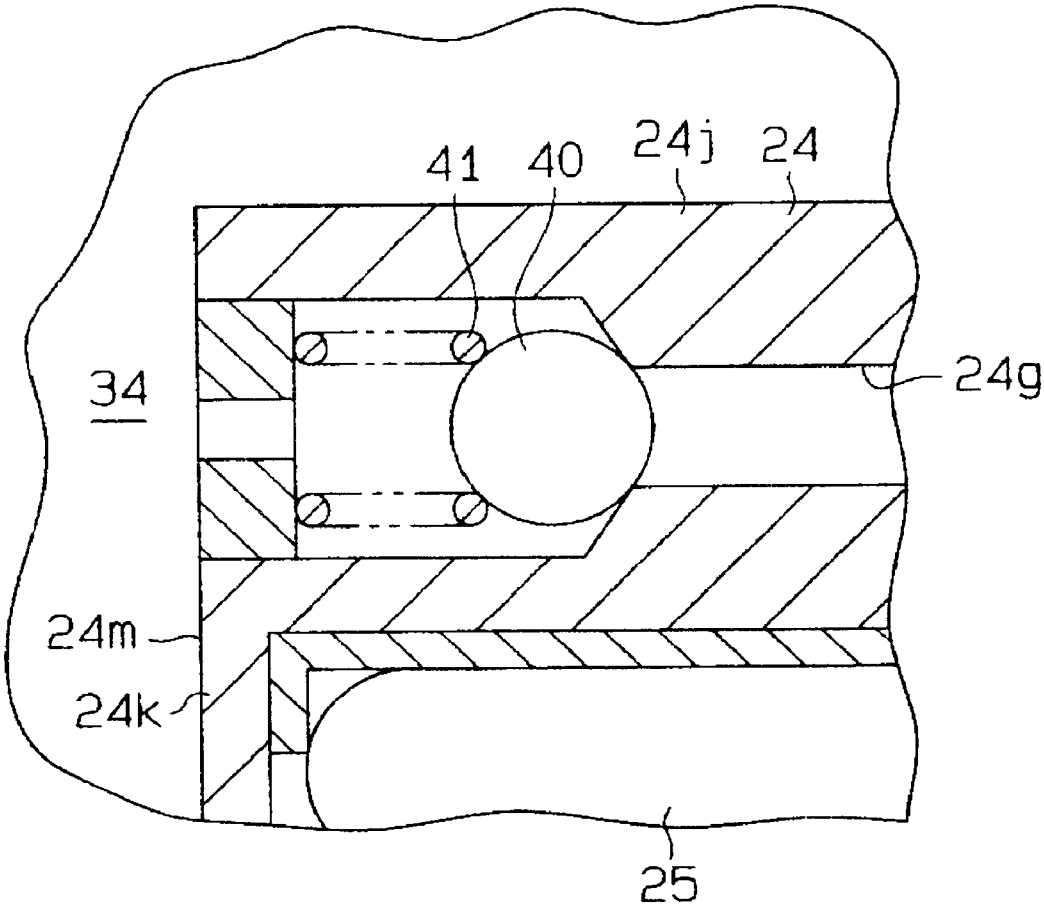
FIG. 2 is a longitudinal-sectional view illustrating a relief valve of a scroll type compressor according to another preferred embodiment of the present invention.

In the present embodiment, the following alternative embodiments are also practiced. In the above-described embodiment, a reed valve is adopted as the relief valve 35. In an alternative embodiment to the preferred embodiment, however, a relief valve 35 other than the reed valve, such as a ball valve and a float valve, is adopted. Referring to FIG. 2, the ball valve is adopted as the relief valve 35. In the present embodiment, the relief valve 35 includes a ball 40 and a spring 41. The ball 40 opens and closes the communication hole 24*g* and serves as a valve body. The spring 41 urges the ball 40 so as to close the communication hole 24*g*.

In the above-described embodiment, the relief valve 35 is operated to sense the pressure differential between the front side and rear side of the relief valve 35 by itself. That is, the relief valve 35 is an internally autonomous valve. In an alternative embodiment to the preferred embodiment, however, an electromagnetic valve is adopted as the relief valve 35. Also, the compressor has a pressure detecting sensor for detecting the pressure in the intermediate compression chambers 26A and 26B, and a pressure detecting sensor for detecting the pressure in the discharge port 20*c*. The electromagnetic valve is externally controlled so as to open and close the communication passage in accordance with a pressure value detected by each pressure detecting sensor.

In alternative embodiments to the preferred embodiment, the communication passage and the relief valve 35 do not require forming on the movable scroll member 24. The communication passage that interconnects intermediate compression chambers with a discharge port, and a relief valve are formed on the fixed scroll member.

In the above-described embodiment, the discharge port 20*c* is formed in the fixed base plate 20*a*. In an alternative embodiment to the preferred embodiment, however, a discharge port is formed in a movable base plate.

In the above-described embodiment, the gas, which is compressed in the scroll type compressor for the fuel cell, is not limited to air. In an alternative embodiment to the preferred embodiment, hydrogen that serves as a fuel for the fuel cell is adopted as the gas.

In the above-described embodiment, the compressor is used for a fuel cell. The compressor is not limited to the use for the fuel cell. In an alternative embodiment to the preferred embodiment, however, a refrigerant compressor is used for a vehicle air conditioning apparatus.

Therefore, the present examples and embodiments are to be considered as illustrative and not restrictive and the invention is not to be limited to the details given herein but may be modified within the scope of the appended claims.

What is claimed is:

1. A scroll type compressor comprising:

a housing having a fixed scroll member which has a fixed base plate and a fixed spiral wall that extends from the fixed base plate;

a movable scroll member placed in the housing, the movable scroll member having a movable base plate and a movable spiral wall that extends from the movable base plate, the movable spiral wall being engaged with the fixed spiral wall;

a plurality of compression chambers defined between the movable scroll member and the fixed scroll member, the compression chambers being moved radially and inwardly to compress gas by orbiting the movable scroll member relative to the fixed scroll member while reducing their volume, the compression chambers having at least a first intermediate compression chamber and a second intermediate compression chamber, in which gas compression is in progress, respectively;

a discharge port formed substantially at the center of the fixed base plate or the movable base plate for sending the compressed gas to an outside of the housing;

a communication passage for interconnecting each intermediate compression chamber with the discharge port, the communication passage having at least a first portion and a second portion, the first portion extending from the first intermediate compression chamber, the second portion extending from the second intermediate compression chamber, the first portion and the second portion meeting at a meeting point on the way in the communication passage before reaching the discharge port; and a relief valve placed between the meeting point and the discharge port inclusive of the meeting point in the communication passage, wherein the relief valve opens the communication passage when the pressure in the first and the second intermediate pressure chambers is higher than the pressure in the discharge port.

2. The scroll type compressor according to claim 1, further comprising:

a cooling chamber defined in the housing, into which a coolant is supplied, wherein the cooling chamber adjoins the compression chambers through the fixed base plate.

3. The scroll type compressor according to claim 1, wherein the relief valve is placed in a space that is surrounded by the fixed scroll member and the movable scroll member.

4. The scroll type compressor according to claim 1, wherein the relief valve is placed on the movable scroll member.

5. The scroll type compressor according to claim 4, further comprising:

a crankshaft for supporting the movable scroll member in the housing, wherein the movable scroll member has a boss that protrudes substantially from the center of a surface of the movable base plate at the movable spiral wall side, the boss having an inserted portion in which the crankshaft is inserted, the boss also having a bottom wall for closing the inserted portion at the opposite side to the side where the crankshaft is inserted, the bottom wall having an outer surface that faces to the fixed base plate, on which the relief valve is placed.

6. The scroll type compressor according to claim 1, wherein the communication passage includes a communication chamber, the meeting point being located in the communication chamber.

7. The scroll type compressor according to claim 6, further comprising:

a cover fixedly joined to a back surface of the movable base plate for defining the communication chamber between the cover and the movable base plate, wherein at least a first communication hole and a second communication hole are formed through the movable base plate, the first and the second communication holes interconnecting the first and the second intermediate compression chambers with the communication chamber, respectively.

8. The scroll type compressor according to claim 1, wherein the compressor is for use in a fuel cell of an electric vehicle, the compressor compressing the gas that is supplied to the fuel cell.

9. The scroll type compressor according to claim 1, wherein a ball valve is adopted as the relief valve.

10. The scroll type compressor according to claim 1, wherein the gas includes air or hydrogen.

11. The scroll type compressor according to claim 1, wherein the housing and the movable scroll member are made of aluminum or aluminum alloy.

12. A scroll type compressor comprising:

a housing having a fixed scroll member which has a fixed base plate and a fixed spiral wall that extends from the fixed base plate;

a movable scroll member placed in the housing, the movable scroll member having a movable base plate and a movable spiral wall that extends from the movable base plate, the movable spiral wall being engaged with the fixed spiral wall, the movable scroll member having a boss that protrudes substantially from the center of a surface of the movable base plate at the movable spiral wall side;

a cover fixedly joined to a back surface of the movable base plate for defining a communication chamber between the cover and the movable base plate;

a plurality of compression chambers defined between the movable scroll member and the fixed scroll member, the compression chambers being moved radially and inwardly to compress gas by orbiting the movable scroll member relative to the fixed scroll member while reducing their volume, the compression chambers having at least a first intermediate compression chamber and a second intermediate compression chamber, in which gas compression is in progress, respectively;

a first communication hole formed through the movable base plate for interconnecting the first intermediate compression chamber with the communication chamber;

a second communication hole also formed through the movable base plate for interconnecting the second intermediate compression chamber with the communication chamber;

a central chamber surrounded by the fixed scroll member and the movable scroll member substantially at a central part of the scroll of the fixed spiral wall;

a third communication hole formed through the boss for interconnecting the communication chamber with the central chamber;

a discharge port formed substantially at the center of the fixed base plate for sending the compressed gas to an outside of the housing; and a relief valve placed on a surface of the boss that faces to the fixed base plate, the relief valve opening the third communication hole to the central chamber when the pressure in the first and the second intermediate pressure chambers is higher than the pressure in the discharge port.

13. The scroll type compressor according to claim 12, further comprising:

a cooling chamber defined in the housing, into which a coolant is supplied, wherein the cooling chamber adjoins the compression chambers through the fixed base plate.

14. The scroll type compressor according to claim 12, wherein the compressor is for use in a fuel cell of an electric vehicle, the compressor compressing the gas that is supplied to the fuel cell.

15. The scroll type compressor according to claim 12, wherein a ball valve is adopted as the relief valve.

16. The scroll type compressor according to claim 12, wherein the gas includes air or hydrogen.

17. The scroll type compressor according to claim 12, wherein the housing and the movable scroll member are made of aluminum or aluminum alloy.

* * * * *

UNITED STATES PATENT AND TRADEMARK OFFICE

CERTIFICATE OF CORRECTION

PATENT NO. : 6,716,009 B2
DATED : April 6, 2004
INVENTOR(S) : Sowa et al.

It is certified that error appears in the above-identified patent and that said Letters Patent is hereby corrected as shown below:

Column 2,
Line 57, please delete “a rotor. 14,” and insert therefore -- a rotor 14, --.

Signed and Sealed this

Third Day of August, 2004

JON W. DUDAS
*Acting Director of the United States Patent and Trademark Office*